US008096367B2

(12) United States Patent
McGivery

(10) Patent No.: US 8,096,367 B2
(45) Date of Patent: Jan. 17, 2012

(54) EXCAVATION SYSTEM AND METHOD

(75) Inventor: John W. McGivery, Scarborough (CA)

(73) Assignee: Enbridge Technology Inc., Calgary, Alberta (CA)

( * ) Notice: Subject to any disclaimer, the term of this patent is extended or adjusted under 35 U.S.C. 154(b) by 174 days.

(21) Appl. No.: 11/524,902

(22) Filed: Sep. 22, 2006

(65) Prior Publication Data

US 2007/0012463 A1 Jan. 18, 2007

Related U.S. Application Data

(62) Division of application No. 10/430,303, filed on May 7, 2003, now Pat. No. 7,128,165.

(51) Int. Cl.
*A01B 33/06* (2006.01)

(52) U.S. Cl. ..... 172/25; 173/28

(58) Field of Classification Search ..... 172/25; 111/200, 900; 404/24, 25, 94; 212/299; 175/402, 403, 320, 394, 426; 299/39.1, 39.6, 299/39.3, 41.1; 173/28, 31
See application file for complete search history.

(56) References Cited

U.S. PATENT DOCUMENTS

| | | | | |
|---|---|---|---|---|
| 2,501,411 | A * | 3/1950 | Ryan | 175/232 |
| 2,776,114 | A | 1/1957 | Brown | 173/31 |
| 3,144,135 | A | 8/1964 | Brown | 212/35 |
| 3,302,731 | A | 2/1967 | Perry | 173/112 |
| 3,491,844 | A * | 1/1970 | Kelly, Jr. | 175/398 |
| 3,507,338 | A * | 4/1970 | Alexander et al. | 173/28 |
| 3,525,404 | A | 8/1970 | Kelly et al. | 173/4 |
| 3,548,604 | A * | 12/1970 | Campbell | 405/303 |
| 3,576,218 | A * | 4/1971 | Lisenby | 173/28 |
| 3,696,625 | A | 10/1972 | Alexander | 405/303 |
| 3,768,578 | A | 10/1973 | Russell | 173/150 |
| 4,050,526 | A | 9/1977 | Deike | 173/27 |
| 4,228,862 | A | 10/1980 | Causse | 175/242 |
| 4,809,788 | A * | 3/1989 | Nelson | 173/28 |
| 4,968,101 | A | 11/1990 | Bossow | 299/41.1 |
| 5,222,564 | A | 6/1993 | Bonca | 173/189 |
| 5,451,128 | A | 9/1995 | Hattersley | 408/204 |
| 6,129,163 | A | 10/2000 | Hamilton et al. | 175/403 |
| 6,494,276 | B1 * | 12/2002 | Hamilton et al. | 175/403 |
| 6,619,413 | B2 | 9/2003 | Hamilton et al. | 175/403 |

FOREIGN PATENT DOCUMENTS

| | | |
|---|---|---|
| CA | 600903 | 7/1960 |
| CA | 1050527 | 3/1979 |
| CA | 1075225 | 4/1980 |
| CA | 801028 | 10/1980 |

* cited by examiner

*Primary Examiner* — Alicia Torres
(74) *Attorney, Agent, or Firm* — Dimock Stratton LLP; Etienne de Villiers

(57) ABSTRACT

A system and method of cutting for replacement a replaceable coupon out of a paved surface for keyhole excavation provides a truck with a turret to which a support arm supporting a cutter assembly is mounted, and a stabilizing member remote from the turret, which allows the turret to be rotated while stabilizing the support arm at any desired position about the truck.

17 Claims, 6 Drawing Sheets

EXCAVATION SYSTEM AND METHOD

CROSS-REFERENCE TO RELATED APPLICATIONS

This application is a divisional of application Ser. No. 10/430,303, filed May 7, 2003.

FIELD OF THE INVENTION

This invention relates to excavating. In particular, this invention relates to a system and method for excavating a roadway or other finished surface.

BACKGROUND OF THE INVENTION

Excavation is a necessary part of the repair procedure for many types of services which run under roadways, parking lots and other finished surfaces, for example a gas or water line running underneath a road or sidewalk. Traditionally, a jackhammer or trimack are used to break up the concrete or asphalt and an excavating machine such as a backhoe would remove the surface cover and uncover the service requiring maintenance and repair. The repair or other servicing would be effected, the excavation backfilled, and the surface refinished using a comparable material (asphalt, concrete, etc. as required to blend in with the surrounding surface finish).

This type of excavation is costly, in terms of both the inconvenience which results from having to remove and refinish a large portion of the road, sidewalk or other finished surface, particularly for example on a busy roadway, and the size of the hole which must be repaired following servicing. Many repair and maintenance procedures do not require a large excavation, and very localized access is sufficient to enable work crews to affect the service procedure. However, conventional excavating machinery is incapable of excavating with the precision required to provide only the opening necessary to access the service being repaired.

Accordingly, an excavating system comprising a rotary cutter mounted on a truck has been developed for performing what is commonly known as a "keyhole" excavation. The cutter is effectively a large hole saw, which cuts a circular "coupon" or "core" out of the finished surface allowing localized access to the service requiring maintenance or repair, mounted to a motor which is in turn mounted on a large drill press.

In such a keyhole excavation device the rotary cutting tool is mounted on a turret so that it can be positioned at various angles about the truck. A hydraulic actuator operates the press, forcing the rotating cutting head into the finished surface at a controlled rate to cut the core. Once the cutting head has penetrated the surface it is retracted to remove the core, and the core is placed aside. The opening is excavated down to the depth of the pipe in need of servicing using conventional vacuum technology, the repair or other service procedure effected, and the opening is backfilled. The core is then placed on a bed of bonding agent to refinish the surface. When the bonding agent hardens, the core has been reintegrated with the surface and in all cases the separation of the core from the surrounding surface will be barely noticeable. The savings of time and avoidance of inconvenience by effecting repairs and servicing through such keyhole excavation, and especially the savings in restoration costs, is significant.

The keyhole excavation is often required beside a roadway which may not be fully accessible to the truck, so the rotary cutter head is mounted on an arm which can move about the truck on a turret within an arc of approximately 270°. This allows the cutting head to be positioned along either side of the truck, or along the back of the truck, which permits some flexibility in the positioning of the truck, to ensure that the truck is in a stable position before cutting commences. For example, the truck can be positioned on the shoulder of a road, or within one lane, so as to minimize the disruption of vehicular traffic.

However, the vertical hydraulic press assembly used to force the cutting head into the finished surface is supported on a horizontal arm which has a single stabilizing point, i.e. at the turret, and it is accordingly difficult to keep the press—and thus the cutter—stable during drilling. Imperfections in the cutting head and obstructions in the finished surface cause the support arm to vibrate. These vibrations are transferred to the vertical press, which causes the support arm to shift about the drilling access which in turn causes the vibration to increase. The resulting instability makes cutting difficult in some cases, and limits the size and depth of the rotary cutter head because a deeper rotary cutter head both causes greater vibration and, due to the greater distance between the cutting edge and the shaft, shifts more under the influence of the vibration.

It would accordingly be advantageous to provide a more stable system and method for cutting a core out of a finished surface as part of a keyhole excavation process.

SUMMARY OF THE INVENTION

The present invention overcomes these disadvantages by providing a system and method of cutting a core out of a finished surface for keyhole excavation which results in a stable cutting procedure with less vibration. This makes the keyhole excavation procedure safer and more precise, and allows a larger-depth cutting head to be used in order to penetrate thicker finished surfaces.

The invention accomplishes this by providing a stabilizing member remote from the turret, which allows the turret to be rotated about its complete arc while stabilizing the support arm at each position within the turret's arc of motion.

In a first embodiment an apparatus according to the invention comprises an upstanding support rim affixed to or integrated into the bed of the truck, which approximates the height of the turret and forms a secondary support remote from the turret. In a further embodiment in the invention comprises a support member affixed to the horizontal arm, for example a strut or brace moveable along and supported by the truck bed.

In the preferred embodiment the cutter head is provided with a pilot, which guides the cutter head during the cutting operation. The pilot also creates a pilot hole in the core that both facilitates removal, manipulation and replacement of the core, and improves the integrity of the reinstated core because the reinstatement compound intrudes into the pilot hole and sets to form a vertical bridge structure that provides vertical support and resistance to lateral shifting.

The present invention thus provides a system for cutting an opening in a paved surface, comprising: a truck having a bed; a support arm mounted on a turret supported by the truck, a cutter press mounted on the support arm, being moveable from a generally horizontal position to a generally vertical position, a rotary cutter comprising a motor and a cutter head mounted on the cutter press for cutting a replaceable core out of the paved surface such that the core remains in substantially the same condition for reinstatement into the paved surface, and a secondary support for supporting the support arm at a position remote from the turret.

The present invention further provides a method of cutting an opening through a paved surface, comprising the steps of:

a) rotating a turret to position a cutter head supported on a support arm over a desired location of the opening, b) rotating the cutter head, c) supporting the support arm at a position remote from the turret, d) pressing the cutter head into the paved surface, e) removing the core from the paved surface; and f) reinstating the core into the paved surface in substantially the same condition as when it was removed from the paved surface.

BRIEF DESCRIPTION OF THE DRAWINGS

In drawings which illustrate by way of example only a preferred embodiment of the invention.

DETAILED DESCRIPTION OF THE INVENTION

Figure 1:
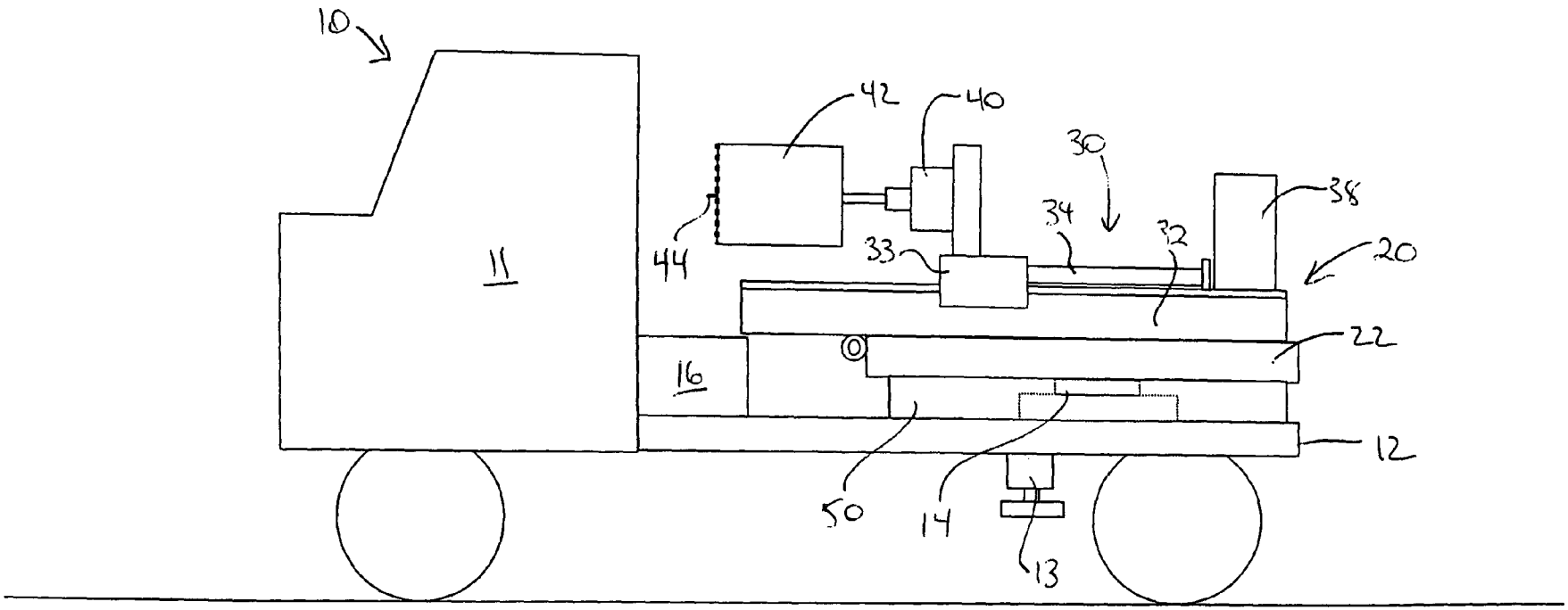
FIG. 1 is a schematic side elevation of a first embodiment of the invention showing the drill press in a storage position.
Figure 2:
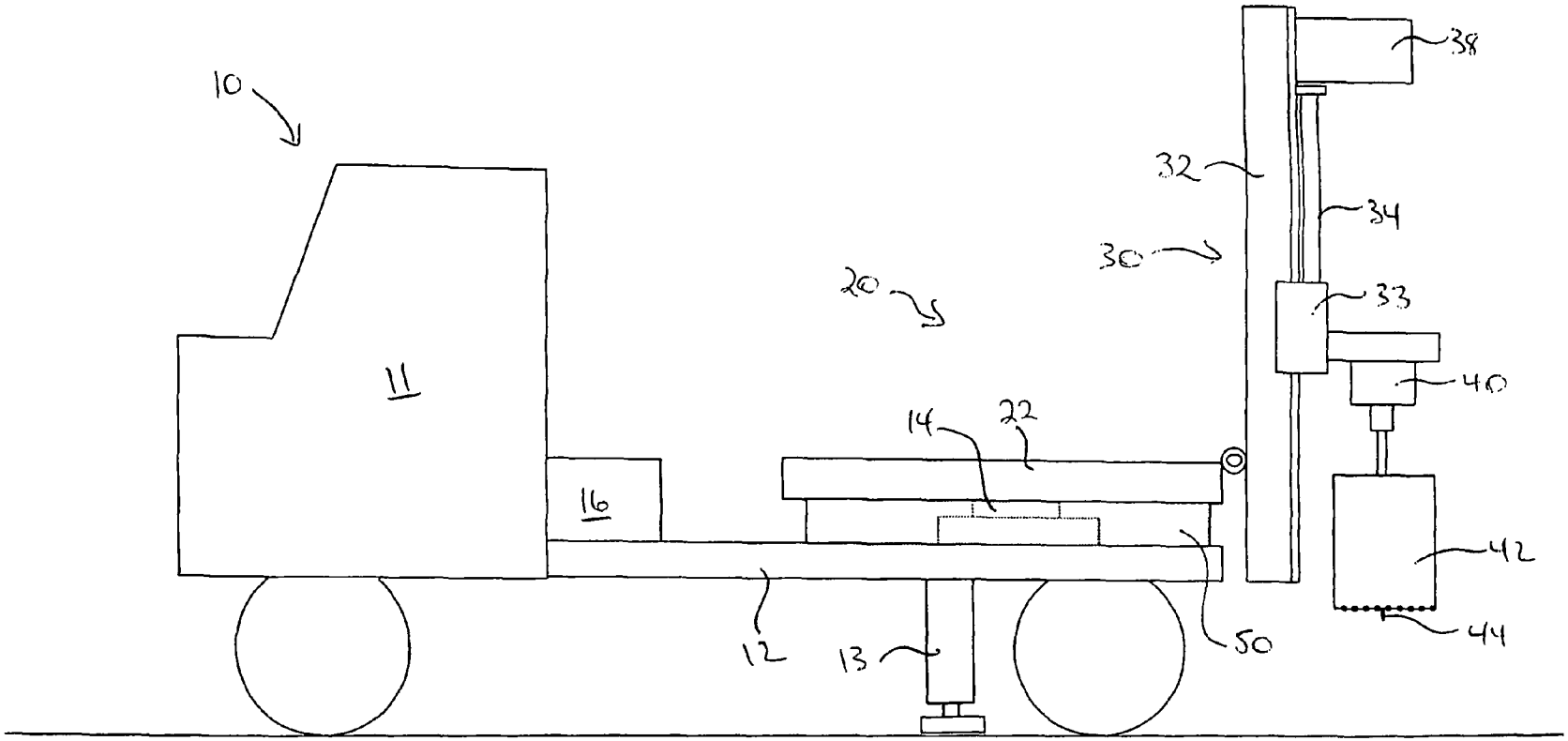
FIG. 2 is a schematic side elevation of the embodiment of FIG. 1 showing the drill press in a drilling position.
Figure 3:
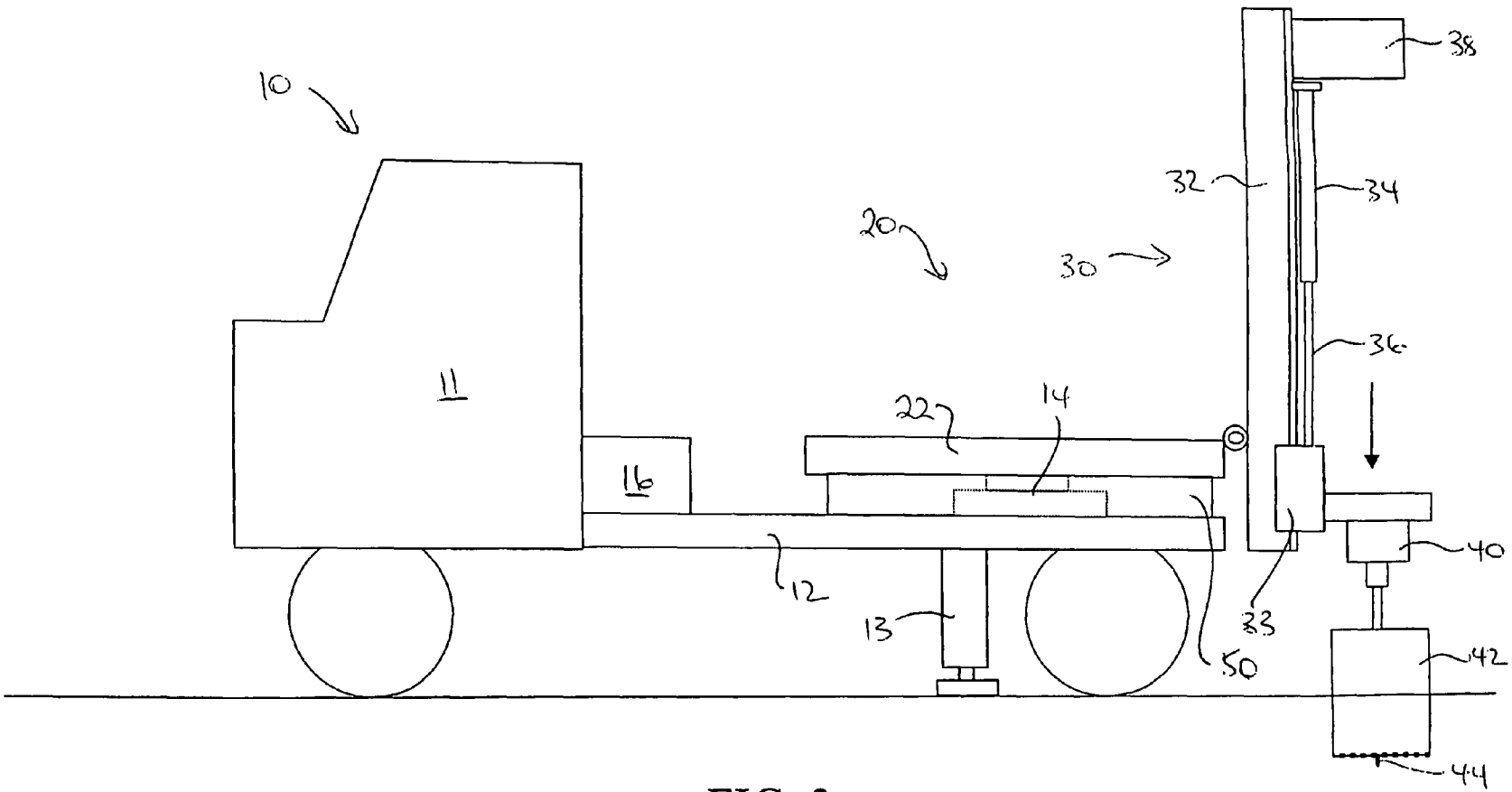
FIG. 3 is a schematic side elevation of the embodiment of FIG. 1 showing the cutter drilling through a surface.

FIGS. 1 to 3 illustrate a first embodiment of the system of the invention. A truck 10 comprising a back portion, preferably having a flat bed 12, is provided with a rotary turret 14 which supports the cutter assembly 20. The turret 14 is driven by a worm gear (not shown) mounted to the bed 12 understructure and decking, and operated by a built in or remote pendant control (not shown). The hydraulic pump 16 is mounted to the bed 12 immediately behind the cab 11 of the truck 10. The bed 12 is otherwise unobstructed, to allow for a large arc of motion of the cutter assembly 20, as described below.

Figure 5:
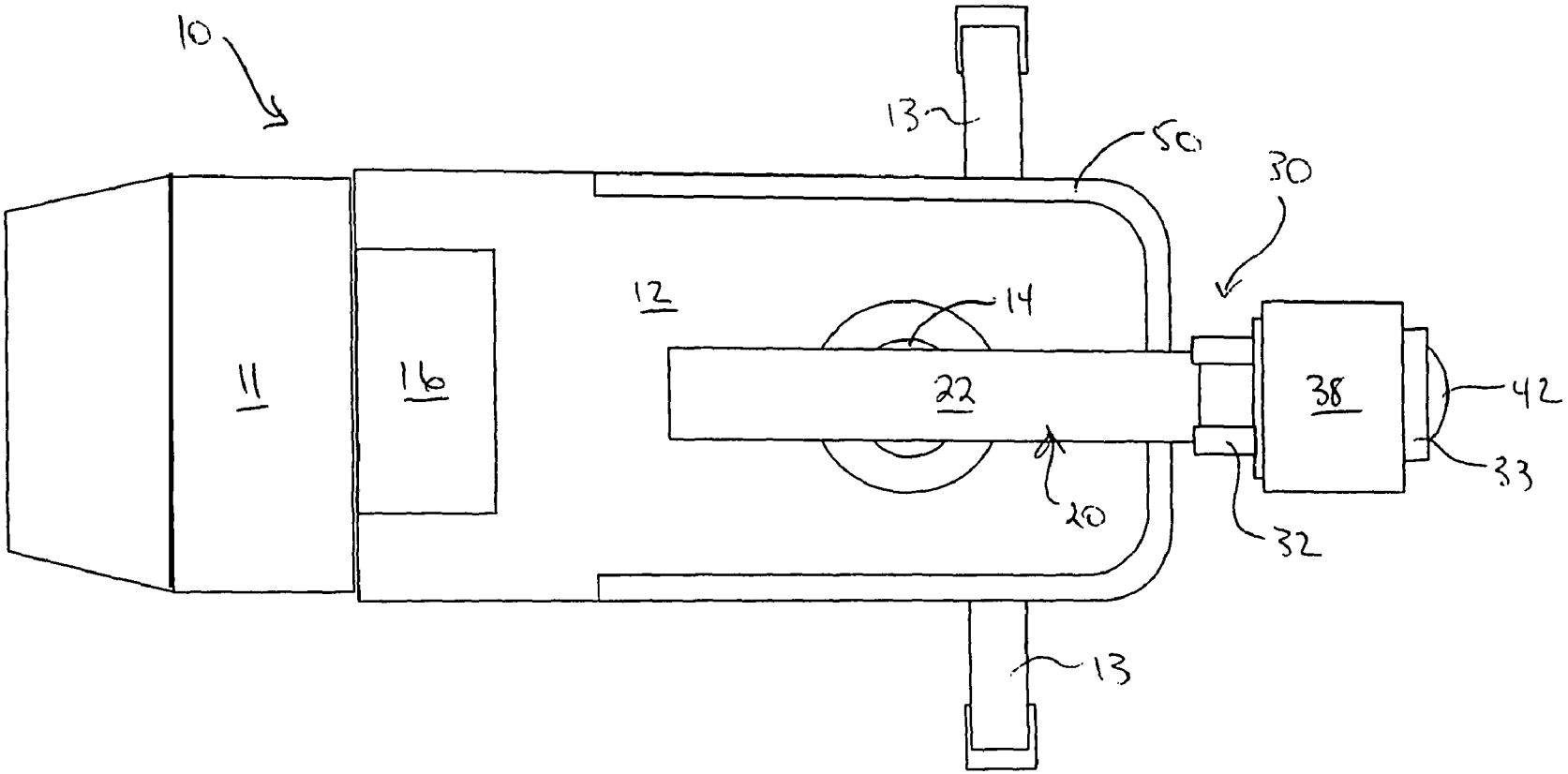
FIG. 5 is a schematic top plan view of the embodiment of FIG. 1.

The cutter assembly 20 is mounted to the turret 14. The cutter assembly 20 comprises a horizontal support arm 22, which may for example be composed of steel bar or tubing or another suitable material, extending sufficiently beyond the periphery of the truck 10 to support the vertical cutting press 30 (described below) at a position which allows it to clear the rear corners of the bed 12. The turret 14 is accordingly preferably positioned equidistant from the rear edge of the bed 12 and the side edges of the bed 12, as shown in FIG. 5.

The cutter press 30 comprises a frame 32 supporting a hydraulic cylinder 34 having a piston 36 fixed to sliding frame 33 to which the cutter motor 40 is mounted. The piston 36 preferably provides approximately a 30" drill stroke for an 18" depth core, which allows the pilot bit 44 to be positioned with sufficient clearance above the surface before cutting while allowing the cutter head 42 to penetrate to its entire depth before the press 30 bottoms out. A water tank 38 is mounted to the top end of the frame 32, to supply coolant to the cutter head 42 when in use.

The supporting member, comprising a ledge or raised edge 50 (best seen in FIG. 5), circumscribes a sufficient portion of the periphery of the bed 12 that the horizontal arm 22 can rotate throughout its entire range of motion (approximately 270°) with the support arm 22 supported on the raised edge 50. The raised edge 50 thus provides a secondary support point, which acts in conjunction with the turret to provide two-point stabilization of the horizontal support arm during the cutting process. This has the effect of reducing the cantilever of the support arm 22, to thus reduce the "play" in the support arm 22 and, commensurately, its susceptibility to vibration. The secondary support point also dampens any vibration which is transferred to the support arm 22.

In operation, the truck 10 is manoeuvred to a convenient position for cutting, and rear stabilizer legs 13 actuated by the hydraulic pump 16 are set into position to stabilize the truck 10. The cutter assembly 30 is in the storage position shown in FIG. 1. The operator rotates the turret at least 45°, so that the distal end of the horizontal support arm extends beyond the periphery of the truck bed 12. The operator pivots the cutter assembly 30 to a substantially vertical position, and aligns the pilot 44 over the center of the opening to be cut. The operator actuates the hydraulic pump to force the piston 36 out of the cylinder 34 and thus force the pilot 44 into the surface. When the teeth of the rotary head 42 contact the surface, the operator opens a valve to start coolant flowing from the tank 38 into the cutter head 42. The water is preferably communicated to the cutter head and pilot by an electric water pump (not shown).

The operator monitors the cutter head 42 as it progresses through the finished surface. When the core 70 breaks free, the operator stops the cutter motor 42 and actuates the hydraulic pump 38 to retract the piston 36 into the cylinder 34 and remove the core 70 from the finished surface 2. The operator rotates the turret to move the cutter assembly 30 away from the opening so that the material below the finished surface can be excavated. A plate (not shown) may be provided in the cutter head, supported on the pilot 44, which can be pushed by a pole (not shown) extending through an opening in the top of the cutter head 42, to force the core 70 out of the cutter head if necessary without damaging the core 70.

Figure 4:
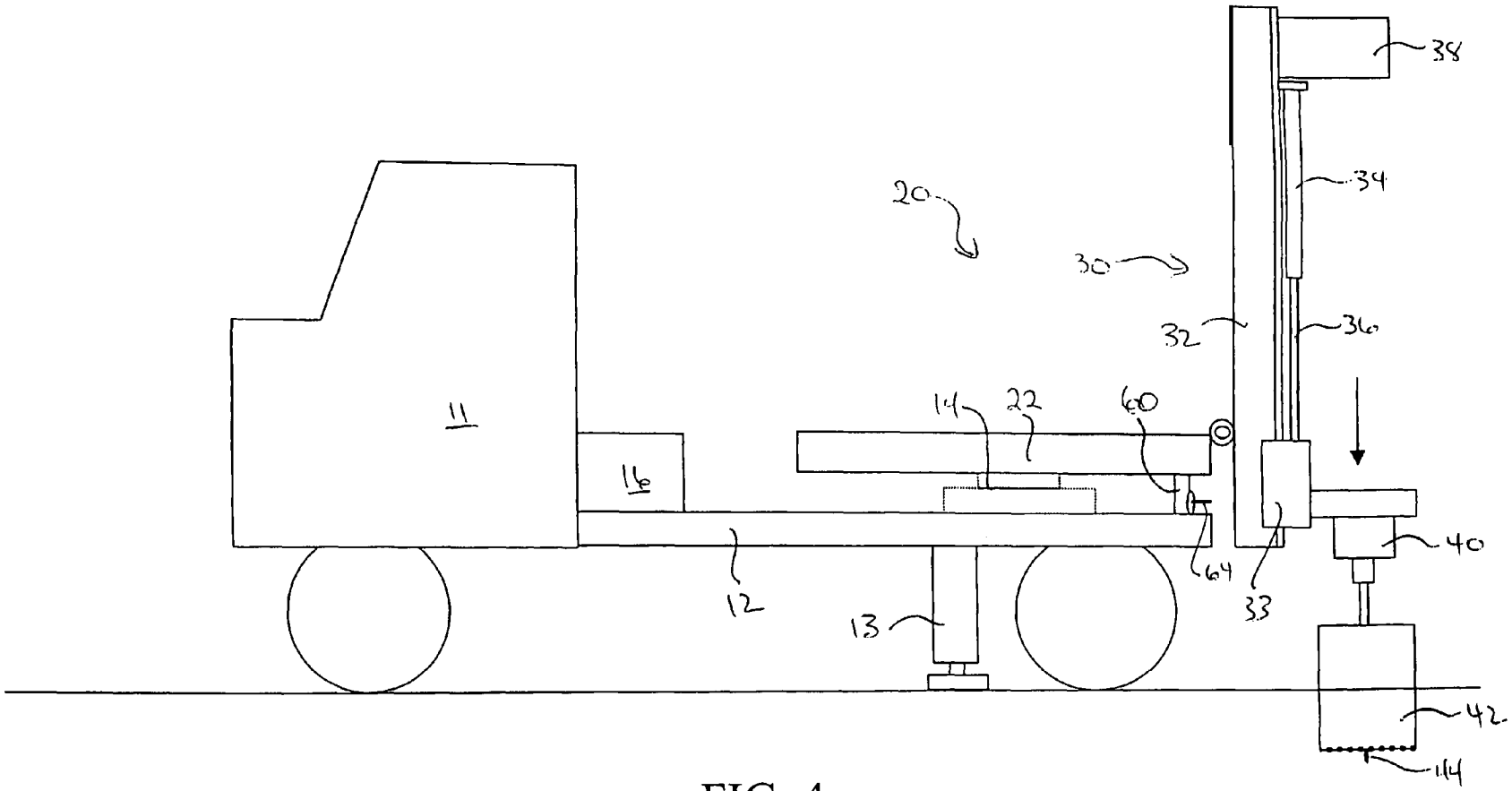
FIG. 4 is a schematic side elevation of a further embodiment of the invention having a support member affixed to the support arm.
Figure 6:
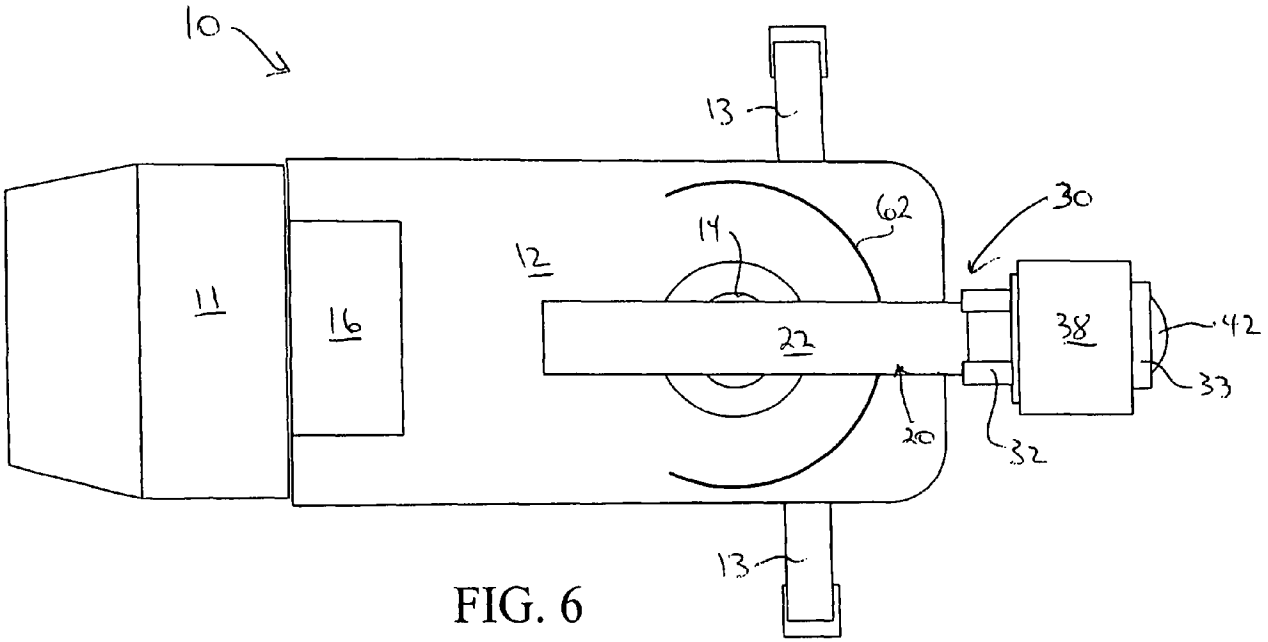
FIG. 6 is a schematic top plan view of the embodiment of FIG. 4.
Figure 7:
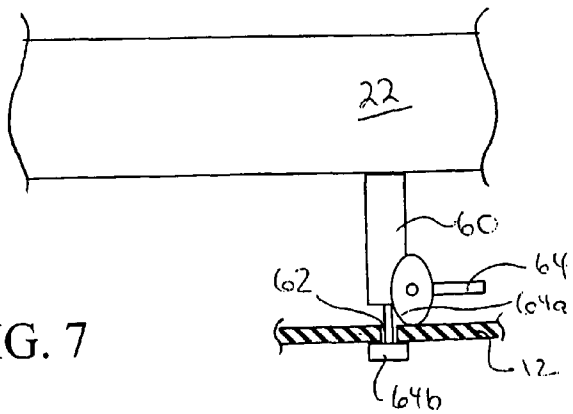
FIG. 7 is an enlarged elevation of a locking mechanism for the embodiment of FIG. 4.

In the embodiment illustrated in FIGS. 4 and 6, the support member comprises a brace 60 welded or otherwise suitably affixed to the horizontal support arm and extending down to the truck bed 12. The brace 60 is lodged in a groove or track 62 formed in the truck bed 12, which restrains the lower end of the brace 60 against horizontal motion. In the preferred embodiment, a locking means, for example a handle 64 having a cam surface **64*a* (seen in FIG. 7), can be rotated to bear against the bed 12 of the truck 10 and lock the support member 60 in the groove 62 between the cam 64*a* and a ledge 64*b*** at a selected position for cutting. Any other locking means can be used. The operation is otherwise as described above.

During the cutting process, the horizontal support arm 22 is stabilized by two points of support: the turret, which supports the fixed end of the horizontal arm 22, and the stabilizing member 50 or 60, which supports the horizontal arm 22 at an intermediate point between the turret and the cutter assembly 30. The support member 50 or 60 thus dampens vibrations being fed back into the horizontal support arm from the cutter head, increasing the stability of the cutter assembly 30 and thus facilitating the cutting of the core 70. After the repair or other service procedure is complete, the core 70 is replaced in conventional fashion.

Figure 8:
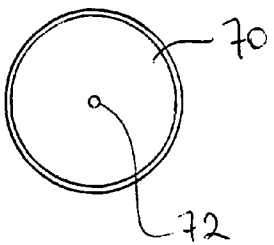
FIG. 8 is a top plan view of the core after the cutting operation.

The pilot 44 guides the cutter head 42 during the cutting operation, and also creates a pilot hole 72 in the core 70, illustrated in FIG. 8. The pilot hole 72 facilitates removal, manipulation and replacement of the core 70. The pilot hole 72 also improves the integrity of the reinstated core 70, because the reinstatement compound is applied wet and as the core 70 is lowered into the hole the compound intrudes into the pilot hole 72 and then sets, forming a vertical bridge structure (not shown) that adheres to the pilot hole 72, providing both vertical support and resistance to lateral shifting.

Various embodiments of the present invention having been thus described in detail by way of example, it will be apparent to those skilled in the art that variations and modifications may be made without departing from the invention. The invention includes all such variations and modifications as fall within the scope of the appended claims.

What is claimed is:

1. A system for cutting and removing a replaceable coupon from a paved surface, comprising:

a truck having a bed;

a turret supported by the truck;

a cutter assembly comprising a support arm and a cutter press;

the support arm mounted on the turret;

the cutter press comprising a frame and a rotary cutter slidably mounted on the frame;

the frame only mounted on the support arm by a pivotal mount at a point on the frame directly to an end of the support arm to allow the cutter press to pivot from a generally horizontal position to a generally vertical position;

a secondary support supported by the truck, the secondary support providing direct support at an intermediate point along the support arm between the turret and the pivotal mount;

wherein during operation the support arm is provided with two-point stabilization by the turret and the secondary support and the frame is solely supported by the pivotal mount at the end of the support arm.

2. The system of claim 1 wherein the rotary cutter comprises a pilot that creates a pilot hole in the replaceable core.

3. The system of claim 1 wherein the rotary cutter comprises a cutter motor for rotating a cutter head, the cutter motor slidably mounted on the frame.

4. The system of claim 3 further comprising:

a hydraulic cylinder mounted on the frame;

the hydraulic cylinder having a piston fixed to a sliding frame; and, the cutter motor mounted on the sliding frame.

5. The system of claim 4 wherein the piston provides a stroke of about 30 inches.

6. The system of claim 4 further comprising:

a water tank for providing cutter heads coolant mounted to a top end of the frame.

7. The system of claim 1 wherein the secondary support is affixed to the support arm at the intermediate point and is supported by the bed.

8. The system of claim 1 further comprising:

a track on the bed;

the secondary support being configured to be movable along and supported by the track.

9. The system of claim 8, further comprising a lock for retaining the secondary support in the track at a selected position.

10. The system of claim 1 wherein the secondary support comprises a raised edge on the bed extending in an arc about the turret and positioned to engage the support arm at the intermediate point along the support arm.

11. A method of cutting for replacement a replaceable coupon from a paved surface, the method comprising:

rotating a turret supported by a truck to position a distal end of a support arm mounted on the turret toward a desired location of the replaceable coupon;

pivoting a frame only attached by a pivotally mount at a point on the frame to the distal end from a generally horizontal position to a generally vertical position;

rotating a cutter head attached to a cutter motor, the cutter motor slidably mounted on the frame;

supporting, the support arm with two-point stabilization by supporting the support arm at the turret and directly at an intermediate position along the support arm between the turret and the distal end with a secondary support supported by the truck;

supporting the frame only by the pivotal mount at the distal end of the support arm;

pressing the rotating cutter head into the paved surface by sliding the cutter motor towards the paved surface; and, cutting a replaceable coupon from the paved surface.

12. The method of claim 11 wherein before pressing the rotating cutter head into the paved surface, the method further comprising:

creating a pilot hole in the replaceable coupon.

13. The method of claim 11, wherein before pressing the rotating cutter head into the paved surface, the method further comprising:

bracing the support arm against horizontal motion with a locking means mounted on the support arm at a position between the turret and the cutter head.

14. The method of claim 11 wherein the cutter motor is connected to a piston of a hydraulic cylinder mounted to the frame, and sliding the cutter motor comprises actuating the hydraulic cylinder to force the piston out of the cylinder to force the cutter motor in the direction of the paved surface.

15. The method of claim 11 wherein after cutting the replaceable coupon, further comprising:

removing the replaceable coupon from the paved surface creating an opening;

excavating material through the opening;

replacing excavated material through the opening; and, replacing the replaceable coupon in the opening.

16. The method of claim 1 wherein the secondary support comprises a raised edge on the truck extending in an arc about the turret and positioned to engage the support arm at the intermediate point along the support arm.

17. The method of claim 1 wherein the secondary support comprises a brace affixed directly to the support arm at the intermediate point along the support arm, the brace configured to be movable with the support arm while riding along a track on the truck to support the support arm.

* * * * *